US006078295A

United States Patent [19]

Rawle

[11] Patent Number: 6,078,295

[45] Date of Patent: Jun. 20, 2000

[54] TRI-BAND ANTENNA

[75] Inventor: Walter D. Rawle, Lynchburg, Va.

[73] Assignee: Ericsson Inc., Research Triangle Park, N.C.

[21] Appl. No.: 09/275,683

[22] Filed: Feb. 24, 1999

[51] Int. Cl.[7] ..... H01Q 1/00

[52] U.S. Cl. ..... 343/730; 343/791; 343/792; 343/876

[58] Field of Search ..... 343/715, 725, 343/727, 730, 745, 747, 790, 791, 792, 850, 858, 860, 876

[56] References Cited

U.S. PATENT DOCUMENTS

| | | | |
|---|---|---|---|
| 4,366,485 | 12/1982 | Hodgkinson | 343/791 |
| 4,382,260 | 5/1983 | Ranghelli | 343/730 |
| 5,307,078 | 4/1994 | Tanaka et al. | 343/791 |
| 5,311,201 | 5/1994 | Lillie et al. | 343/791 |
| 5,668,564 | 9/1997 | Seward et al. | 343/791 |

*Primary Examiner*—Tan Ho
*Attorney, Agent, or Firm*—Wood, Phillips, VanSanten, Clark & Mortimer

[57] ABSTRACT

An antenna for use with low-band, mid-band and high-band signals, including a coaxial member, a low-band and mid-band signal input connected between one end of the coaxial member outside conductor and the device chassis ground, and a high-band signal input connected between one end of the coaxial member outside conductor and the corresponding end of the coaxial member inside conductor. A first isolation filter adapted to block low-band and mid-band signals from the coaxial member is between the coaxial member and the high-band signal input. A parallel resonant circuit is at the other end of the coaxial member outside conductor and a solid conductor is connected to the parallel resonant circuit and to the other end of the coaxial member inner conductor. The low-band signal input is disconnected from high-band signals by, for example, an RF switch or a second isolation filter between the coaxial member and the low-band signal input.

11 Claims, 2 Drawing Sheets

TRI-BAND ANTENNA

BACKGROUND OF THE INVENTION

1. Technical Field

The present invention is directed toward antennas, and more particularly toward antennas for use with signals in different frequency bands.

2. Background Art

Antennas are an important component of those devices which communicate by radio waves. The ability to reliably send and receive signals is largely dependent on proper functioning of the antenna.

The performance of any antenna, specifically quantified by its radiation pattern and feedpoint impedance characteristics, is fundamentally controlled by the electric current distribution established upon the radiating structure by the associated input (excitation source). For portable and mobile radio communications applications, the optimum radiation pattern characteristics are defined by a single omni-directional pattern lobe with the principal axis of the lobe situated at 90 degrees with respect to the radiating structure.

For applications involving multi-band portable and mobile radio terminals, and more specifically for applications involving three or more bands of operation, optimum radiation characteristics are difficult to obtain for all bands when using simple radiating structures. In general, if a simple radiating structure, such as a monopole, is designed for low-band operation in a multi-band application, the resulting harmonically related current distributions resulting from excitation at the higher frequency bands will not yield the required radiation pattern characteristics for the higher bands. If the simple radiating structure is, by contrast, designed for high-band operation in a multi-band application, the feedpoint impedance bandwidth is restrictively narrow at the lower frequency bands, thus complicating and increasing the cost of the associated antenna-radio impedance matching circuitry. Given the growing competition in the field of radio communications, cost of all components, including antennas, is an important consideration.

The present invention is directed toward overcoming one or more of the problems set forth above.

SUMMARY OF THE INVENTION

In one aspect of the invention, an antenna is provided for use with low-band, mid-band and high-band signals. The antenna includes a coaxial member, a low-band and mid-band signal input connected between one end of the coaxial member outside conductor and the device chassis ground, and a high-band signal input connected between one end of the coaxial member outside conductor and the corresponding end of the coaxial member inside conductor. A first isolation filter adapted to block low-band and mid-band signals from the coaxial member is between the coaxial member and the high-band signal input. A parallel resonant circuit is at the other end of the coaxial member outside conductor and a solid conductor is connected to the parallel resonant circuit and to the other end of the coaxial member inner conductor. Means are also provided for isolating the low-band signal input from high-band signals.

In alternate preferred forms of this aspect of the invention, the isolating means is either an RF switch, or a second isolation filter between the coaxial member and the low-band signal input and adapted to block high-band signals from the coaxial member.

In another preferred form of this aspect of the invention, the first isolation filter creates an impedance along the coaxial member adapted to block low-band and mid-band signals.

In still another preferred form of this aspect of the invention, the parallel resonant circuit creates an impedance adapted to block high-band signals at the circuit.

In another aspect of the present invention, an antenna is provided for use with low-band and high-band signals, including a low-band signal input, a parallel resonant circuit, a first conductor connected at one end to the low-band signal input and at the other end to the parallel resonant circuit, a second conductor, and a high-band signal input connected to one end of the second conductor and to the one end of the first conductor. A solid conductor is connected to the parallel resonant circuit and to the other end of the second conductor. A first isolation filter is provided between the first and second conductors and the high-band signal input to block low-band and mid-band signals from the conductors, and means are further provided for disconnecting the low-band signal input from high-band signals.

In a preferred form of this aspect of the present invention, the antenna is also usable with mid-band signals, the mid-band signal being input at the low-band signal input.

In alternate preferred forms of this aspect of the invention, the disconnecting means is either an RF switch, or a second isolation filter between the first conductor and the low-band signal input and adapted to block high-band signals from the first conductor.

In another preferred form of this aspect of the invention, the first isolation filter creates an impedance along the second conductor adapted to block low-band and mid-band signals.

In still another preferred form of this aspect of the invention, the parallel resonant circuit creates an impedance adapted to isolate the solid conductor from the first conductor.

It is an object of the invention to provide a low cost antenna which may be reliably used in multi-band applications.

DESCRIPTION OF THE PREFERRED EMBODIMENT

Figure 1:
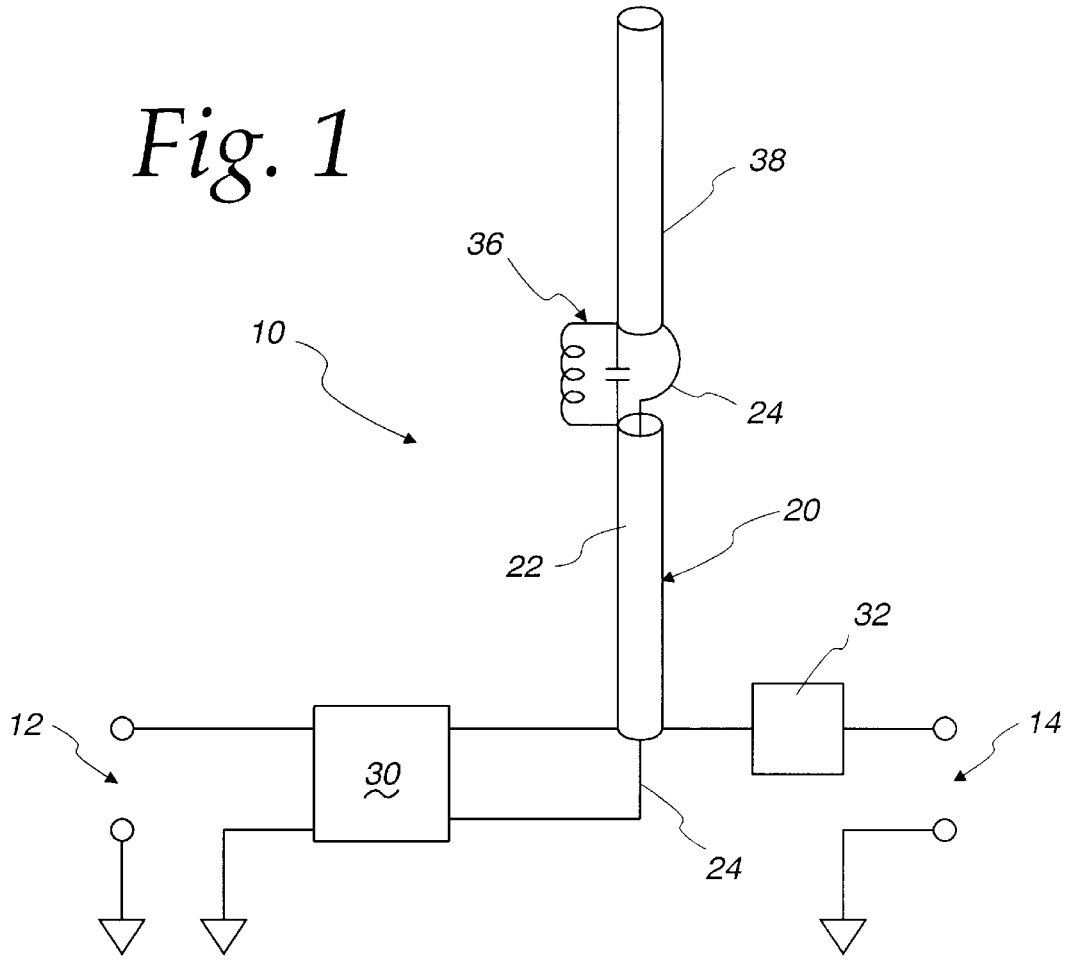
FIG. 1 is a diagram of a first preferred embodiment of the antenna of the present invention.

One embodiment of the antenna 10 of the present invention is illustrated in FIG. 1.

The antenna includes a high-band input or feed point 12 (excitation source) for inputting high-band signals for transmission by the antenna, and a low-band input 14 (excitation source) for inputting low-band signals for transmission by the antenna 10.

The antenna further includes a two conductor member, preferably a coaxial member 20 such as shown, with an outside conductor 22 insulated from an inner conductor 24.

One end of the outside conductor 22 is connected to the low-band input 14 and is also connected to the high-band input 12. More specifically, and as described in further detail below, the outside conductor 22 is connected to an isolation filter 30 at the high-band input and to an RF switch 32 (such as a PIN diode RF switch) at the low-band input 14.

The one end of the inner conductor 24 is also connected to the high-band input 12 through the isolation filter 30.

The other end of the outside conductor is connected to a parallel resonant circuit 36. The parallel resonant circuit 36 and the adjacent end of the inner conductor 24 are connected to a solid conductor 38.

Operation of the FIG. 1 embodiment is thus as follows.

For operation with low-band signals, the signals are input at the low-band input 14 passed through the RF switch 32 on to the outside conductor 22, through the circuit 36, and on to the solid conductor 38. The parallel resonant circuit 36 presents an inductive reactance at the low band which may be used to fine tune the feedpoint impedance of the antenna 10 at the low-band frequency. Further, the isolation filter 30 is fixed tuned to present an impedance for the low-band signals (and, as described below, for mid-band signals) which, when translated along the inner conductor 24 to the connection of the inner conductor 24 to the solid conductor 38, effectively yields an open circuit so as to effectively disconnect the inner conductor 24 from inclusion in the antenna 10 during low-band operation.

Figure 2:
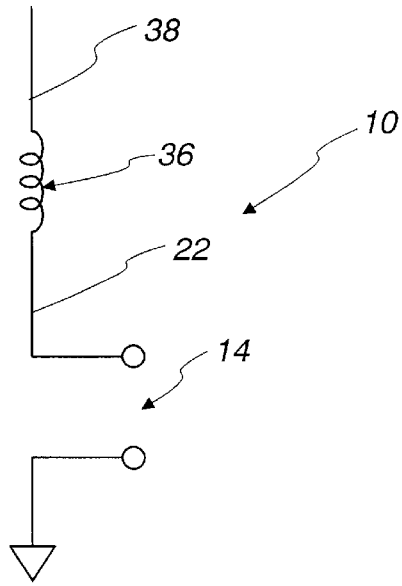
FIG. 2 is a schematic diagram illustrating low-band and mid-band operation of the antenna of the present invention.

It should thus be appreciated that, as shown in FIG. 2, in low-band operation, the antenna 10 will operate as a monopole antenna end fed against the ground plane (e.g., the chassis of the device). Since low-band operation will have the longest wavelengths, in the preferred form the length of the signal carrying conductors 22, 38 is substantially equal to ¼ of the signal wavelength for design low-band signals.

Mid-band operation is substantially the same as the above described low-band operation and as shown in FIG. 2, except that the antenna 10 is a different relative length of the signal wavelength. Specifically, in the preferred form, the design mid-band signals will have wavelengths which are half the wavelengths of the low-band signals (i.e., twice the frequency) so that the antenna 10 operates as a half wave monopole antenna end fed against the ground plane (vs. the quarter wave monopole antenna during low-band operation), it being known in the art that antenna lengths which are multiples of quarter wavelengths provide desired operation.

Figure 3:
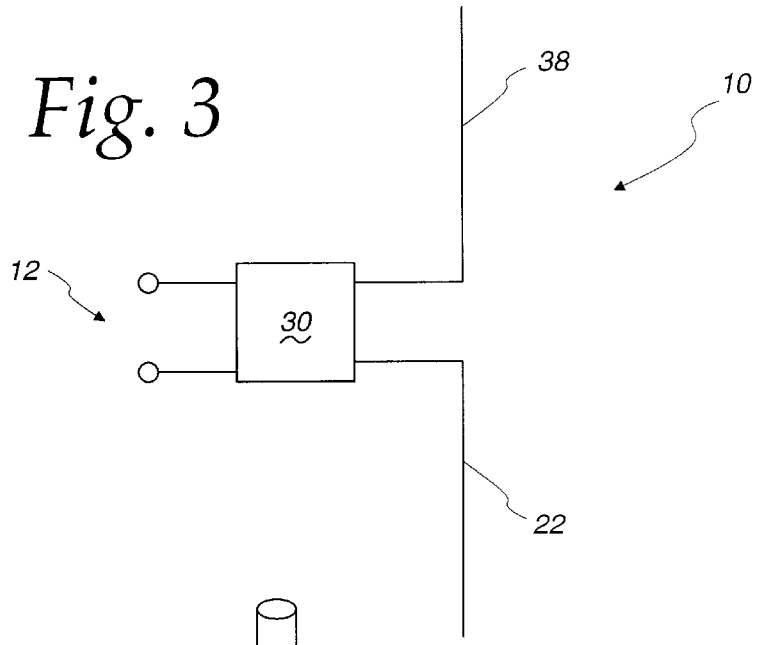
FIG. 3 is is a schematic diagram illustrating high-band operation of the antenna of the present invention.

High-band operation is different from mid- and low-band operation, as the antenna 10 then operates as a center fed full wave dipole (in the preferred form, the design high-band signals have wavelengths which are ¼ the wavelengths of the low-band signals [i.e. four times the frequency] so that the same effective antenna length is thereby a full wavelength). Specifically, during high-band operation, the signal current is transmitted up the inner conductor 24 (the isolation filter 30 does not impede high-band excitation) to the solid conductor 38 which is thereby excited to form one half of the full wave dipole, and is also introduced to the outside conductor 22, effectively travelling up the inside of the outside conductor 22 and then back down the outside of the outside conductor 22 generating optimum radiation pattern characteristics at both conductors 22, 38. The parallel resonant conductor 36 is tuned for this high-band operation so that it presents essentially an infinite impedance to the solid conductor 38, thereby effectively disconnecting the solid conductor 38 from the outside conductor 22, with the solid conductor 38 and the outside conductor 22 thereby operating as separate halves of a center fed full wave dipole as schematically illustrated in FIG. 3. Further, in the FIG. 1 embodiment, the RF switch 32 functions to disconnect the circuitry associated with the low-band input 14 from the outside conductor 22 (thereby preventing that circuitry from interfering with the functioning of the outside conductor 22 as half of the full wave dipole).

Figure 4:
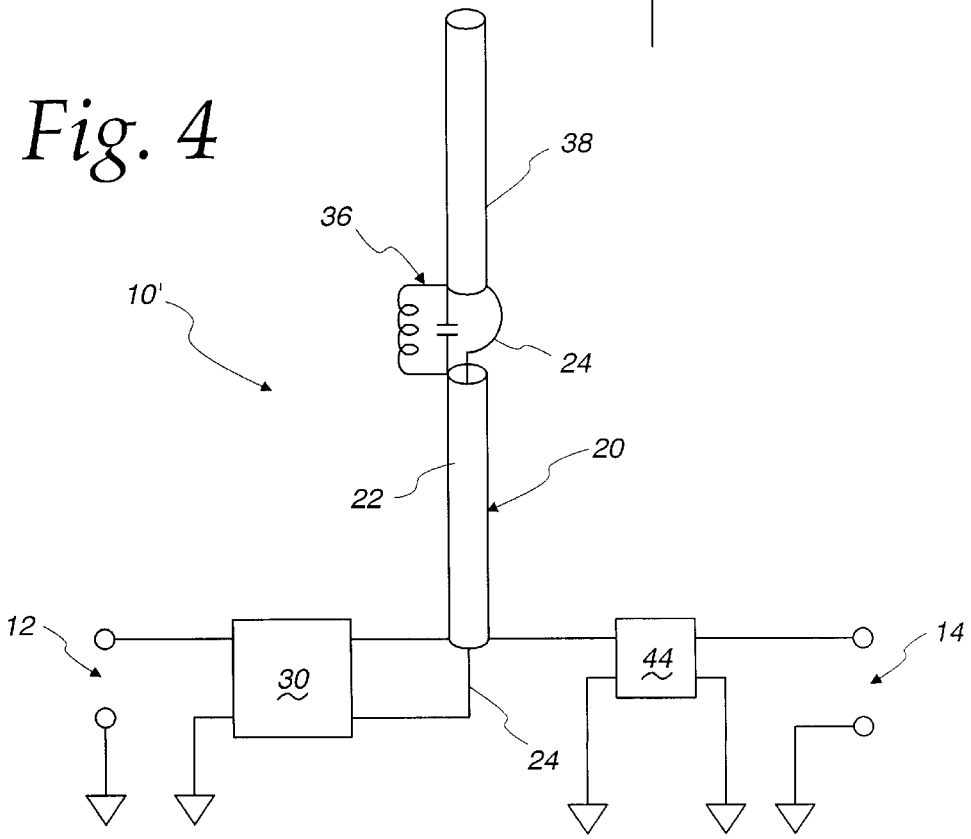
FIG. 4 is is a diagram of a second embodiment of the antenna of the present invention.

FIG. 4 illustrates a preferred alternate embodiment of antenna 10' the present invention. Many of the components of the FIG. 4 embodiment are essentially the same as the FIG. 1 embodiment components. Therefore, the same reference numerals are used for such components, and the previous description of such components and their operation is applicable here so that it is not repeated here.

The principal difference of the FIG. 4 embodiment versus the FIG. 1 embodiment is the presence of a second isolation filter 44 between the outside conductor 22 and the low-band input 14. This second isolation filter 44 does not impede low-band and mid-band excitation, but does impede high-band excitation so as to essentially create an open circuit condition for high-band signals, thereby preventing the circuitry associated with the low-band input 14 from interfering with the functioning of the outside conductor 22 as half of the full wave dipole for the high-band signals. It should be appreciated that this structure permits the antenna 10' to be simultaneously operated on all three bands as it does not disable input from low-band and mid-band signals during high-band operation. Further, the current distributions for each of the bands would be simultaneously maintained so that optimum radiation patterns for all three bands could be simultaneously achieved.

It should thus be appreciated that the present invention will provide ideal operation for multi-band operation, including simultaneous operation for the multiple bands, all of this being accomplished with a simple and inexpensive structure.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

What is claimed is:

1. An antenna for use with low-band, mid-band and high-band signals, comprising:

a coaxial member having an outside conductor about an inner conductor;

a low-band signal input connected to one end of the coaxial member outside conductor;

a parallel resonant circuit at the other end of the coaxial member outside conductor;

a high-band signal input connected to one end of the coaxial member inner conductor and said one end of the coaxial member outside conductor;

a first isolation filter between said coaxial member and said high-band signal input, said first isolation filter adapted to block low-band and mid-band signals from said coaxial member;

a solid conductor connected to said parallel resonant circuit and to the other end of the coaxial member inner conductor; and means for disconnecting said low-band signal input from high-band signals.

2. The antenna of claim 1, wherein said disconnecting means comprises an RF switch.

3. The antenna of claim 1, wherein said disconnecting means comprises a second isolation filter between said coaxial member and said low-band signal input, said second isolation filter adapted to block high-band signals from said coaxial member.

4. The antenna of claim 1, wherein said first isolation filter creates an impedance along said coaxial member inner conductor adapted to block low-band and mid-band signals.

5. The antenna of claim 1, wherein said parallel resonant circuit creates an impedance adapted to isolate the solid conductor from the coaxial member outside conductor.

6. An antenna for use with low-band and high-band signals, comprising:

a low-band signal input;

a parallel resonant circuit;

a first conductor connected at one end to said low-band signal input and at the other end to said parallel resonant circuit;

a second conductor;

a high-band signal input connected to one end of the second conductor and to said one end of said first conductor;

a first isolation filter between (a) said first and second conductors and (b) said high-band signal input, said first isolation filter adapted to block low-band signals from said conductors;

a solid conductor connected to said parallel resonant circuit and to the other end of the second conductor; and means for disconnecting said low-band signal input from high-band signals.

7. The antenna of claim 6, wherein said antenna is also usable with mid-band signals, said mid-band signal being input at said low-band signal input.

8. The antenna of claim 6, wherein said disconnecting means comprises an RF switch.

9. The antenna of claim 6, wherein said disconnecting means comprises a second isolation filter between said first conductor and said low-band signal input, said second isolation filter adapted to block high-band signals from said first conductor.

10. The antenna of claim 6, wherein said first isolation filter creates an impedance along said second conductor adapted to block low-band signals.

11. The antenna of claim 6, wherein said parallel resonant circuit creates an impedance adapted to isolate the solid conductor from the first conductor.

* * * * *